US009073742B2

(12) United States Patent
Hanssen et al.

(10) Patent No.: US 9,073,742 B2
(45) Date of Patent: Jul. 7, 2015

(54) TAP FOR FLUIDS AND VALVE FOR USE IN SAID TAP

(75) Inventors: Hubert Joseph Frans Hanssen, Amsterdam (NL); Willem Terpstra, Zeewolde (NL)

(73) Assignee: Eurokeg B.V., Den Helder (NL)

( * ) Notice: Subject to any disclaimer, the term of this patent is extended or adjusted under 35 U.S.C. 154(b) by 296 days.

(21) Appl. No.: 12/990,974

(22) PCT Filed: May 5, 2009

(86) PCT No.: PCT/EP2009/055424

§ 371 (c)(1),
(2), (4) Date: Jan. 28, 2011

(87) PCT Pub. No.: WO2009/090270

PCT Pub. Date: Jul. 23, 2009

(65) Prior Publication Data

US 2011/0146809 A1 Jun. 23, 2011

(30) Foreign Application Priority Data

May 7, 2008 (EP) ..... 08155837

(51) Int. Cl.

| | |
|---|---|
| ***B67D 1/14*** | (2006.01) |
| ***B67D 1/04*** | (2006.01) |
| ***B67D 1/08*** | (2006.01) |

(52) U.S. Cl.

CPC ..... *B67D 1/1444* (2013.01); *Y10T 29/49815* (2015.01); *Y10T 29/49817* (2015.01); *B67D 1/0431* (2013.01); *B67D 1/0858* (2013.01)

(58) Field of Classification Search

CPC .. B67D 1/0431; B67D 1/0858; B67D 1/1444; Y10T 29/49815; Y10T 29/49817

USPC ..... 222/1, 153.01, 153.05, 153.13, 153.14, 222/505, 538, 544, 548, 532, 562; 137/343, 137/377, 379–382.5

See application file for complete search history.

(56) References Cited

U.S. PATENT DOCUMENTS

| | | | | |
|---|---|---|---|---|
| 659,285 | A * | 10/1900 | Boyle | 137/382 |
| 1,234,477 | A * | 7/1917 | Husher | 251/86 |

(Continued)

FOREIGN PATENT DOCUMENTS

| | | |
|---|---|---|
| EP | 2303762 | 9/2012 |
| GB | 1 213 276 | 11/1970 |

(Continued)

OTHER PUBLICATIONS

Extended European Search Report mailed Feb. 10, 2009 by the European Patent Office, Munich, Germany.

(Continued)

*Primary Examiner* — J. Casimer Jacyna

(74) *Attorney, Agent, or Firm* — Steven M. Koehler; Westman, Champlin & Koehler, P.A.

(57) ABSTRACT

The invention relates to a tap (8) for fluids, in particular carbonated liquids, such as beer or soft drink, comprising a tap body (14), a valve (9) removably accommodated in the tap body (14), and a handle (20) for opening and closing the tap (8). The valve (9) comprises a first part (22) coupled or to be coupled to the tap body (14) and a second part (27) connected to the first part (22) and operatively coupled or to be coupled to the handle (20), the first and second parts (22, 27) being rotatable and/or translatable relative to each other between at least an open position and a closed position. A protective cap (34) prevents the valve (9) from being closed. The cap (34) is removable only after installation of the valve (9) in the tap body (14).

20 Claims, 3 Drawing Sheets

(56) References Cited

U.S. PATENT DOCUMENTS

| | | | | |
|---|---|---|---|---|
| 1,413,502 | A * | 4/1922 | Steinmetz | 220/727 |
| 2,206,707 | A * | 7/1940 | Shaw | 137/382 |
| 3,967,810 | A * | 7/1976 | Pulvermacher | 251/146 |
| 3,980,099 | A * | 9/1976 | Youngblood | 137/382 |
| 4,109,673 | A * | 8/1978 | Horowitz et al. | 137/381 |
| 4,224,959 | A * | 9/1980 | Fling | 137/343 |
| 2004/0226967 | A1 * | 11/2004 | Van Der Klaauw et al. | 222/146.6 |

FOREIGN PATENT DOCUMENTS

| | | |
|---|---|---|
| GB | 2 106 615 | 4/1983 |
| WO | 00/07902 | 2/2000 |
| WO | 2008/000574 | 1/2008 |

OTHER PUBLICATIONS

International Search Report mailed Jul. 10, 2009 by the European Patent Office, The Hague, Netherlands.

Subsequent Substantive Examination Report from Intellectual Property Office of the Philippines Bureau of Patents for related application 1/2010/502426, NPE Date: Oct. 26, 2010.

* cited by examiner

TAP FOR FLUIDS AND VALVE FOR USE IN SAID TAP

PRIORITY CLAIM TO RELATED APPLICATIONS

This application is a national stage application under 35 U.S.C. §371 of PCT/EP2009/055424, filed May 5, 2009, published as WO 2009/090270 A2 on Jul. 23, 2009, and claiming priority to European Application No. 08155837, filed May 7, 2008, which application and publication are incorporated herein by reference and made a part hereof in its entirety, and the benefit of priority of which is claimed herein.

The invention relates to a tap, also referred as dispenser, for fluids, in particular carbonated liquids, such as beer or soft drink, comprising a tap body, a valve removably accommodated in the tap body and preferably connected to a flexible fluid supply hose on one end and having fluid delivery tube on the other end, and a handle for opening and closing the tap. The valve comprises a first part coupled or to be coupled to the tap body and a second part connected to the first part and operatively coupled or to be coupled to the handle, the first and second parts being rotatable and/or translatable relative to each other between at least an open position and a closed position. The invention further relates to a valve for use in said tap and to a method of installing or removing said valve and a flexible hose in respectively from a dispense system.

US 2004/226967 discloses a drink dispenser assembly (denoted by numerals "1" and "25" in the figures of US 2004/226967) comprising a dispenser device (2, 37) provided with a tap (18, 29; erroneously referred to as "dispensing head") for accommodating a flexible plastic dispensing line (17, 28), and a container (7, 27) containing drink, in particular carbonated drink, connected during use to the dispensing line (17, 28) which has a coupling element comprising a shut-off valve at an outlet end for connection to the tap (18, 29). An aim of the invention disclosed in US 2004/226967 is to provide a drink dispenser assembly that allows controlled dispensing and prevents drink leaking from the dispensing line.

It is an object of the present invention to provide a tap, also referred as dispenser, and valve wherein the load on the seal (s) inside the valve is reduced, preferably at least during the period preceding use of the valve in a dispense system.

To this end, a removable protective cap is attached to the valve, which cap prevents the valve from being closed and is removable only after installation of the valve in the tap body. In a further aspect, the protective cap is removable only after closing the valve by means of the handle.

By preventing the valve from being closed during, e.g., storage of the valve and an associated container holding the fluid, deterioration of sealing behavior during use, once installed in a dispense system, resulting from, e.g., (uneven) compression set, is reduced or avoided. Also, as premature removal of the cap is prevented, hygiene is improved.

In one aspect, the valve comprises a drink delivery tube and the removable protective cap is placed over the drink delivery tube.

In further aspect, the protective cap comprises a ledge that locks the protective cap to the valve and that, during installation of the valve, interacts with the tap body to disengage the valve. In a further aspect, the ledge also locks the first and second parts of the valve relative to each other, preventing relative rotation and/or translation.

In yet a further aspect, the protective cap comprises a ledge that locks the protective cap to the valve and that, upon closing the valve with the handle, interacts with the tap body or the handle to disengage the valve.

In another aspect, the first and second parts of the valve comprise through channels which are in register when the valve is open and which have a cross-section which at least substantially corresponds in shape to the cross-section of the lumen of the flexible hose and which have a cross-sectional area of at least 80%, preferably at least 90% of the cross-sectional area of said lumen. Thus, turbulence during dispensing and, in case of e.g. beer, frothing is reduced and dispensing is facilitated, which is especially significant for less experienced users.

In yet another aspect, the first part of the valve comprises a fluid delivery tube and at least one protrusion or notch, e.g. at least two protrusions, such as keys, or notches, such as slots, and the downstream part of the tap body comprises an opening for accommodating the delivery tube and at least one notch or protrusion, e.g. at least two notches or protrusions, respectively, for receiving the protrusion(s) or notch(es) on the first part of the valve thus fixing this first part relative to the tap body in a tangential (rotational) direction, while allowing axial movement of the valve. In an embodiment, the first part of the valve comprises a plurality of keys and the opening comprises a plurality of corresponding slots.

In another aspect, the second part of the valve comprises, about at least part of its circumference, teeth and the handle comprises or is coupled to a crown wheel meshing with the teeth, such that rotation of the crown wheel results in rotation of the first and second parts of the valve relative to each other, e.g. between said open and closed positions.

These aspects facilitate installation of the valve in the tap and enable a relatively straightforward construction of the tap. In a further aspect, the valve can be positioned in the tap body merely by pushing the valve in an axial direction and operating the handle. In an embodiment, the tap body lacks elements, such as doors or hinged parts, intended to gain access to the entrails of the tap body for positioning the valve.

The invention also relates to a valve for use in a tap and to methods of installing and removing such a valve in or from a tap, as defined in claims 14 and 15.

GB 2 106 615 discloses a beertap comprising a tap body (numeral 1 in FIG. 1) with a supply (3) and delivery (12) connection and with closing means provided in the body and formed by two ceramic disks (4, 6) which lie against one another and which are ground smooth. One of said disks (4) is fixed in the tap body (1) and the other (6) is rotatable relative to the first one by means of an operating lever (16) for opening and closing the tap. In each of said disks an axially oriented triangular opening is provided which openings can be brought into and out of coincidence when operating the tap.

The invention will now be explained in more detail with reference to the figures, which show an embodiment of the tap according to the present invention.

Figure 1:
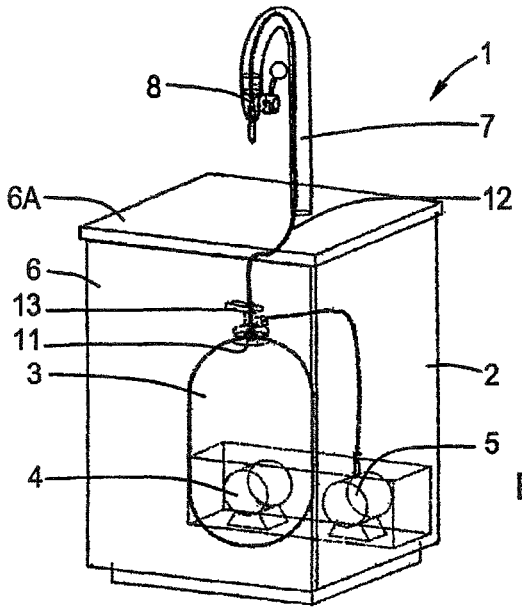
FIG. 1 is a perspective view of a drink dispense system comprising a tap and valve according to the present invention.

The drawings are not necessarily to scale and details, which are not necessary for understanding the present invention, may have been omitted. Further, terms as "upper", "lower", and the like relate to the orientation of elements as shown in the drawings.

FIGS. 1 to 4 show a drink dispense system 1 comprising a refrigerator 2, accommodating a container 3 holding drink, e.g. carbonated drink under pressure, such as beer, a first compressor 4 for providing the refrigerator 2 with a cooling medium, and a second compressor 5 for providing a pressurized gas to the container 3. The drink dispense system 1 further comprises a door 6, a work top 6A, and a tap column 7 provided with a tap 8 removably accommodating a valve 9 comprising a drink delivery tube 10.

In this example, the container 3 comprises a spherical and pressure resistant outer casing having a central opening, a gastight inner casing of a flexible material, i.e. a bag, located inside the outer casing, and a valve part 11, located in the central opening, for filling the container 3, more specifically the inner casing, with a liquid respectively withdrawing liquid from the container 3. In this example, the outer casing was made by blow-moulding a polyester preform, in particular a PET (polyethylene terephthalate) or PEN (polyethylene naphthalate) preform. For examples of suitable containers and valve parts, reference is made to WO 2008/000574 and WO 00/07902 (see especially page 8, line 12 ff. in conjunction with FIGS. 4A and 4B), which are incorporated herein by reference.

The valve 9 in the tap 8 is connected to the container 3 by means of a flexible hose 12 and a dispense head 13, known in itself. The flexible hose is made of a plastic material e.g. of a polyolefin, such as PE or LDPE, and has an outer diameter of e.g. 6 mm.

Figure 2B:
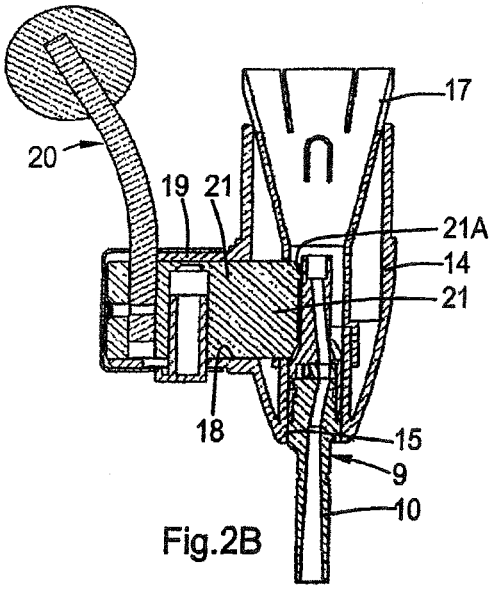
FIGS. 2A and 2B are a bottom view and a cross-section of the tap according to the present invention.
Figure 2A:
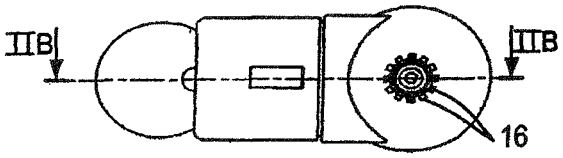
Figure 3:
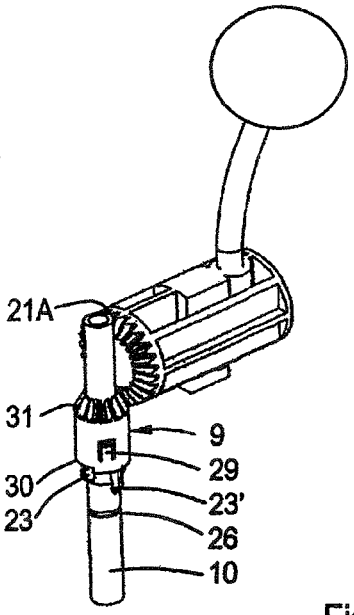
FIG. 3 is a perspective view of the valve and the tap handle of the tap shown in FIGS. 2A and 2B.
Figure 4:
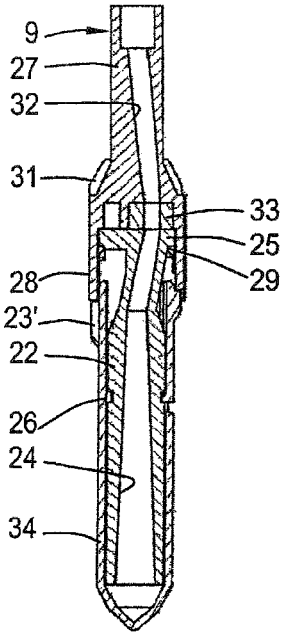
FIG. 4 is a cross-section of a valve according to the present invention.

As shown in FIGS. 2A to 3, the tap comprises a hollow tap body 14 in turn comprising in its downstream end a first opening 15 for accommodating the valve 9. The first opening 15 is provided with a plurality of slots 16, extending in axial direction and evenly distributed about circumference of the first opening 15. A funnel 17, diverging in upstream direction, is located upstream from and in line with the first opening 15. The sidewall of the tap body 14 is provided with second opening 18 and a bush 19 for rotatably accommodating a handle 20 for opening and closing the tap 8. The handle 20 in turn comprises a shaft 21 rotatably and slidably accommodated inside the bush 19, an operating lever attached to one end of the shaft 21 and a crown wheel 21A formed on or attached to the other end of the shaft 21.

The valve 9 comprises a first part 22 comprising the drink delivery tube 10 and a plurality of keys 23 extending in axial direction and distributed about the outer wall in positions corresponding to the slots 16 around the first opening 15 in the tap body 14. To facilitate insertion of the valve 9 into said first opening 15, the distal end of at least some of the keys 23 in inclined and/or one of the keys 23' extends beyond the other keys 23. Both measures facilitate guiding the valve 9 to a proper position in the tap 8. The first part 22 of the valve 9 further comprises a through channel 24 having an upstream section extending at an inclination relative to the central axis of the valve 9 and a concentric downstream section diverging towards the outflow opening. The upstream end of the first part 22 comprises a flange 25 and the delivery tube 10 is provided with a circumferential groove 26 on its outer wall.

A second part 27 of the valve 9 comprises, at its downstream end, a cage 28 provided with one or more resilient ledges 29 locked behind the flange 25 on the first part 22 of the valve 9, thus one the one hand preventing axial movement of the valve parts 22, 27 relative to each other and, on the other hand, allowing relative rotation. The rim of the downstream end comprises a recess 30 extending over part of the circumference to define, together with one or more of the keys 23 on the first part 22 of the valve 9, the extremes of the relative rotation of the parts 22, 27. In this example, the extremes correspond to the opened and closed positions of the valve 9.

Upstream from the resilient ledges 29, the outer wall of the second part 27 comprises about its circumference a plurality of inclined teeth 31 forming a gear ring. The second part 27 further comprises a through channel 32 extending at an inclination relative to the central axis of the valve 9, such that the downstream end of the channel 32 is, in the opened position of the valve shown in FIG. 5B, in register with the upstream end of the channel 24 in the first part 22 and, in the closed position shown in FIG. 5C, coincides with the closed top wall of the first part 22. The upstream end of the through channel 32 in the second part 27 extends coaxially with the central axis of the valve 9 and has an inner diameter slightly smaller than the outer diameter of the flexible hose 12, to enable clamping of the hose 12 to the valve 9. Alternative or additional ways of attaching the hose to the valve include gluing and welding.

The downstream end of the through channel 32 comprises an oblong, oval or kidney-shaped chamber and an identically shaped elastomeric, e.g. rubber, seal 33 having a bore and clamped inside the chamber. The inner diameter of the inclined sections of the through channels 24, 32 and of the bore of the seal 33 have a cross-section and a cross-sectional area that is identical to those of the flexible hose 12.

Figure 7A:
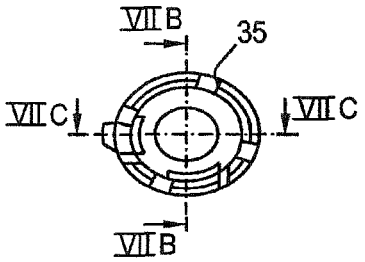
FIGS. 7A to 7C are a top view and two cross-sections of a protective cap as used in the tap and valve in FIGS. 5A to 6B.
Figure 7B:
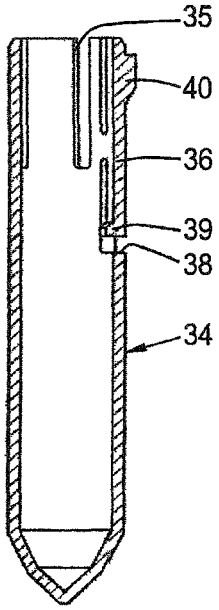
Figure 7C:
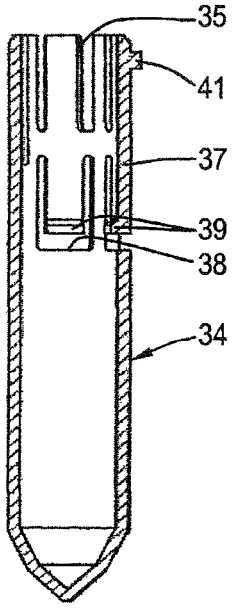

The valve 9 is further provided with a removable protective cap 34, shown in FIGS. 7A to 7C, that prevents the valve 9 from being closed and that is removable only after installation of the valve 9 in the tap body 14 and closing the valve 9 by means of the handle 20. In this example, the protective cap 34 comprises a plurality of axial slots 35 accommodating the keys 23 on the first part of the valve 9 and first and second ledges 36, 37 (FIGS. 7B and 7C, respectively), both having resilient ends defined by cut-outs 38.

The downstream end of the first ledge 36 is provided with an inwardly extending projection 39, in this case having an inclined upper surface and a flat lower surface thus providing, together with the groove 26 in the circumference of the delivery tube 10, one-way snap-fitting of the cap 34 to the valve 9. The upstream end is provided with an outwardly extending projection, in this case an axial key 40 having a flat upper surface providing a stop for axially positioning the cap 34 relative to the valve 9 and an inclined lower surface, the function of which will become apparent below. Also, the upstream end of the axial key 40 extends in the recess 30 in the lower rim of the cage 28 and thus limits or prevents, depending on the position of the limits of the recess 30, the axial key 40, and the keys 23 on the first part 22 of the valve 9, relative rotation of the first and second parts 22, 27 of the valve 9.

The downstream end of the second ledge 37 is identical to that of the first ledge 36. Its upstream end is provided with an outwardly extending projection, in this case a radial key 41 having an inclined leading surface.

Installing a container 3 in the drink dispense system 1 can be performed by putting the handle 20 in a position that corresponds to the open position of the valve 9 and pulling the handle 20 radially outwards (relative to the valve), placing a container 3 inside the refrigerator 2, connecting an assembly of a flexible hose 12 and valve 9 with one end of the hose to a dispense head 13, pushing the valve 9 through the tap column 7, through the funnel 17 and into the first opening 15 in the tap body 14, and connecting the dispense head 13 to the valve 11 of the container 3. As a matter of course, it is also possible to first connect the dispense head to the container and then install the valve in the tap.

Figure 5B:
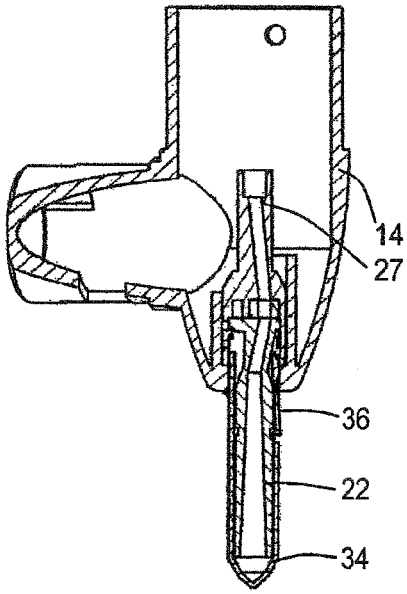
FIGS. 5A to 5C are a bottom view and two cross-section of a tap in the open position.
Figure 5C:
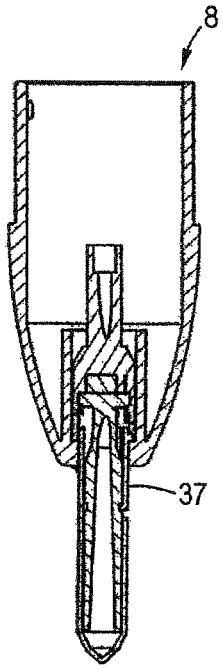
Figure 5A:
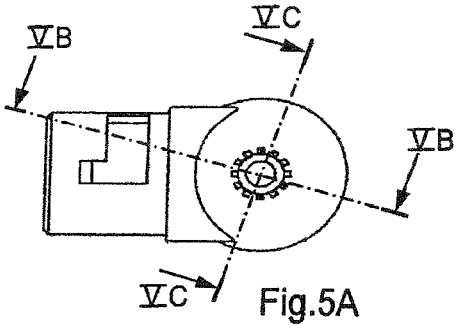

During the inserting of the valve 9 into the first opening 15, the axial key 40 on the first ledge 36 will be pushed inwards by the rim of the first opening 15 and the projection 39 on the other end of the ledge 36 will be lifted and will disengage the valve 9 (FIG. 5B).

Figure 6A:
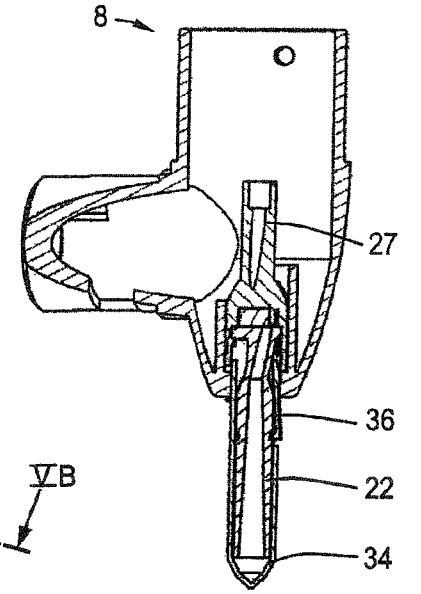
FIGS. 6A and 6B are two cross-sections of the tap in FIGS. 5A to 5C in the closed position.
Figure 6B:
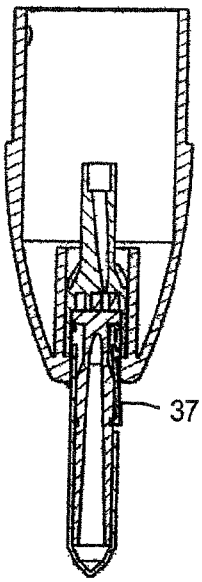

Next, the handle 20 can be pushed inwards thus meshing the crown wheel 21A with the teeth 31 on the valve 9. By putting the handle 20 in a position that corresponds to the closed position of the valve 9, the second part 27 of the valve 9 is rotated relative to the first part 22, which is fixed relative to the tap body 14 in tangential direction. As a result, the radial key 41 on the second ledge 41 is pushed inwards by the cage 28 and the projection 39 on the other end of the second ledge 37 will be lifted and will disengage the valve 9 (FIG. 6B). With both ledges 36, 37 clearing the valve 9, the protective cap 34 can be pulled of in axial direction and the dispense device 1 is ready for use.

Removing a container 3 from the drink dispense system 1 can be performed by the above steps in reverse order. However, the protective cap 34 need not be replaced. Also, to prevent drink from leaking from the hose 12 and the valve 9 and contaminating the tap column 7, the drink can be withdrawn from the valve 9 and at least part of the hose 12 by inducing in the drink a pressure lower than atmospheric pressure, e.g. by simply removing the overpressure from the container 3 and allowing the flexible bag inside the container to relax and thus expand. To amplify and/or accelerate this phenomenon, the bag can be provided with, e.g., resilient elements that straighten upon removal of the overpressure or gas can be actively withdrawn from the container.

To improve hygiene, a disposable valve and a hose can be provided with each container.

The invention is not restricted to the above-described embodiments which can be varied in a number of ways within the scope of the claims. For instance, although the invention has been illustrated by reference to a particular type of valve, i.e. a valve comprising two parts that can be closed or opened through relative rotation, the protective cap according to the invention is also suitable for use with other type of valves, such as valves wherein the parts translate relative to each other.

The invention claimed is:

1. A tap for fluids, comprising:

a tap body;

a valve removably accommodated in the tap body, and;

a handle for opening and closing the valve;

wherein the valve comprises:

a first part coupled or to be coupled to the tap body, and a second part connected to the first part and operatively coupled or to be coupled to the handle, the first and second parts being rotatable and/or translatable relative to each other between at least an open position and a closed position, and a protective cap, wherein the protective cap is attached to the valve and prevents the valve from being closed and is configured to be removable from the valve only after installation of the valve in the tap body;

wherein one end of the valve is connected to a flexible fluid supply hose and the other end of the valve includes a fluid delivery tube.

2. The tap according to claim 1, wherein the protective cap is removable only after closing the valve by means of the handle.

3. The tap according to claim 1, wherein the protective cap comprises a ledge that locks the protective cap to the valve and that, during installation of the valve, interacts with the tap body to disengage the valve.

4. The tap according to claim 1, wherein the protective cap comprises a ledge that locks the protective cap to the valve and that, upon closing the valve with the handle, interacts with the tap body or the handle to disengage the valve.

5. The tap according to claim 1, wherein the first and second parts of the valve comprise through channels which are in register when the valve is open and which have a crosssection which at least substantially corresponds in shape to the cross-section of a lumen of a flexible hose and which have a cross-sectional area of at least 80% of the cross-sectional area of the lumen.

6. The tap according to claim 1, wherein the first part of the valve comprises a fluid delivery tube and at least one protrusion or notch and the downstream part of the tap body comprises an opening for accommodating the delivery tube and at least one notch or protrusion, respectively, for receiving the protrusion(s) or notch(es) on the first part of the valve thus fixing the first part relative to the tap body in a tangential direction, while allowing axial movement of the valve.

7. The tap according to claim 6, wherein the first part of the valve comprises a plurality of keys and the opening comprises a plurality of corresponding slots and wherein preferably one of the keys extends beyond the other keys to facilitate guiding the valve in the tap.

8. The tap according to claim 1, wherein the second part of the valve comprises, about at least part of its circumference, teeth and the handle comprises or is coupled to a crown wheel meshing with the teeth, such that rotation of the crown wheel results in rotation of the first and second parts of the valve relative to each other.

9. The tap according to claim 1, wherein the tap body lacks elements for gaining access to the entrails of the tap body for positioning the valve.

10. A valve, comprising:

a first part configured to be coupled to a tap body of a tap for fluids;

a second part connected to the first part and operatively coupled or to be coupled to a handle of a tap for fluids, the first and second parts being rotatable and/or translatable relative to each other between at least an open position and a closed position, and a protective cap coupled to the first part, the protective cap configured to prevent the valve from being closed, and wherein the protective cap is configured to be removable only after installation of the valve in the tap body;

wherein one end of the valve is connected to a flexible fluid supply hose and the other end of the valve includes a fluid delivery tube.

11. The valve according to claim 10, wherein the protective cap is removable only after closing the valve.

12. The valve according to claim 10, wherein the protective cap comprises a ledge that locks the protective cap to the valve and that, during installation of the valve, interacts with the tap body to disengage the valve.

13. The valve according to claim 10, comprising an elastomeric seal located between the first and second parts and providing, when the valve is open, an at least substantially leak-tight channel through the first and second parts.

14. A method of installing a valve and a flexible hose in a dispense system comprising a column wherein the column includes a tap for fluids, the tap comprising:

a tap body;

a valve removably accommodated in the tap body; and a handle for opening and closing the valve;

wherein the valve comprises:

a protective cap, a first part coupled or to be coupled to the tap body, and a second part connected to the first part and operatively coupled or to be coupled to the handle, the first and second parts being rotatable and/or translatable relative to each other between at least an open position and a closed position, and wherein the protective cap prevents the valve from being closed and is removable only after installation of the valve in the tap body, the method comprising:

putting the handle in a position that corresponds to the open position of the valve, pushing the valve and the flexible hose through the column, inserting the valve in the tap body, and removing the protective cap.

15. Method of removing a valve and flexible hose from a dispense system comprising a column wherein the column includes a tap for fluids, the tap comprising:

a tap body;

a valve removably accommodated in the tap body; and a handle for opening and closing the valve;

wherein the valve comprises:

a protective cap, a first part coupled or to be coupled to the tap body, and a second part connected to the first part and operatively coupled or to be coupled to the handle, the first and second parts being rotatable and/or translatable relative to each other between at least an open position and a closed position, and wherein the protective cap prevents the valve from being closed and is removable only after installation of the valve in the tap body, the method comprising:

putting the handle in a position that corresponds to the open position of the valve, inducing in the fluid a pressure lower than atmospheric pressure, thus withdrawing the fluid from valve and at least the downstream end of the flexible hose, and pulling the valve and the flexible hose from the tap and the column.

16. The tap according to claim 1, wherein the fluids comprise carbonated liquids.

17. The tap according to claim 5, wherein the cross-sectional area of the through channels is at least 90% of the cross-sectional area of the lumen.

18. The tap according to claim 9, wherein the elements comprise doors or hinged parts.

19. The tap according to claim 1, comprising an elastomeric seal located between the first and second parts and providing, when the valve is open, an at least substantially leak-tight channel through the first and second parts.

20. The tap according to claim 1 wherein the first part of the valve comprises a first end and second end is configured to be fixedly coupled to the tap body and wherein the first part includes a first through channel wherein a first end of the channel proximate the first end of the first part is aligned with an axis of rotation of the valve and the second end of the channel proximate the second end of the first part is a distance from the axis of rotation of the valve, and wherein the second part has a first end and a second end, wherein the second end of the second part is rotatably connected to the second end of the first part, wherein the second part of the valve comprises a second channel having a first end proximate the first end of the second part and a second end proximate the second end of the second part wherein the second channel is aligned with the axis of rotation at the first end and wherein the second channel is displaced a distance from the axis of rotation proximate the second end of the second part wherein when the second part is rotated about the axis of rotation into an open position the first and second channels are in register at their second ends and wherein when the second part rotated about the axis of rotation to a closed position, the first and second channels are displaced from each other at their second ends to prevent liquid flow.

* * * * *